US010459376B2

(12) United States Patent
Saito et al.

(10) Patent No.: US 10,459,376 B2
(45) Date of Patent: Oct. 29, 2019

(54) FIXING DEVICE AND IMAGE FORMING APPARATUS

(71) Applicant: KONICA MINOLTA, INC., Chiyoda-ku, Tokyo (JP)

(72) Inventors: Masashi Saito, Hachioji (JP); Atsushi Nakamura, Tokyo (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/354,255

(22) Filed: Mar. 15, 2019

(65) Prior Publication Data

US 2019/0294086 A1 Sep. 26, 2019

(30) Foreign Application Priority Data

Mar. 20, 2018 (JP) ..... 2018-053074

(51) Int. Cl.
*G03G 15/20* (2006.01)
*G03G 15/00* (2006.01)

(52) U.S. Cl.
CPC ..... *G03G 15/2025* (2013.01); *G03G 15/2064* (2013.01); *G03G 15/5016* (2013.01); *G03G 2215/2016* (2013.01)

(58) Field of Classification Search
CPC ..... G03G 15/2025; G03G 15/2064; G03G 15/5016; G03G 2215/2016
See application file for complete search history.

(56) References Cited

U.S. PATENT DOCUMENTS

2014/0064801 A1* 3/2014 Shibaki ..... G03G 15/2025 399/327
2015/0234342 A1* 8/2015 Hatazaki ..... G03G 15/2025 399/327
2015/0253700 A1* 9/2015 Hatazaki ..... G03G 15/2039 399/327

FOREIGN PATENT DOCUMENTS

JP 2015169855 A 9/2015

* cited by examiner

*Primary Examiner* — Gregory H Curran
(74) *Attorney, Agent, or Firm* — Buchanan Ingersoll & Rooney PC

(57) ABSTRACT

A fixing device has a fixing member, a cleaning roller, and a web, a first drive mechanism, a rotation drive unit, and a control unit. The first drive mechanism moves the cleaning roller to abut on or separate from the fixing member. The rotation drive unit can rotatingly drive the cleaning roller when the cleaning roller separates from the fixing member. The control unit performs control such that, in a case where a cleaning mode for cleaning the cleaning roller using the web is selected, the cleaning roller moves to separate from the fixing member and is rotatingly driven, and the web abuts on the cleaning roller, in order to clean the cleaning roller.

13 Claims, 8 Drawing Sheets

FIXING DEVICE AND IMAGE FORMING APPARATUS

BACKGROUND

1. Technological Field

The present invention relates to a fixing device and an image forming apparatus.

2. Description of the Related Art

A fixing device capable of stably fixing a high quality image on a sheet is demanded. In general, in an electrophotographic image forming apparatus using toner, a sheet on which a toner image is formed by an image forming unit is heated and pressed by passing through a fixing nip portion formed between a fixing belt looped around a fixing roller of a fixing device and an pressure roller in order to fix an image on the sheet. In this case, a toner release agent (hereinafter, referred to as "wax") seeps out and adheres to the fixing belt in some cases. In a case where a fixing belt having dirt by wax adhered to some places is used during the fixation, a difference may occur in the fixing state between a part of the fixing belt where the wax is adhered and a part where the wax is not adhered, so that irregularity may occur in the image. Herein, a phenomenon that irregularity occurs in an image fixed on a sheet due to the wax adhered to the fixing belt in this manner is referred to as "gloss memory".

In this regard, a technique for removing the wax adhered to the fixing belt has been developed. For example, a technique of removing the wax from the fixing belt by pressing a cleaning roller capable of pressedly coming into contact with or being released from the fixing belt toward the fixing belt is known in the art. In addition, for dirt of the cleaning roller itself generated by removing the wax from the fixing belt, a technique of preventing accumulation of the wax on the cleaning roller by causing a web (non-woven fabric) to abut on the cleaning roller has also been developed. In this technique, it is possible to improve efficiency of removing the wax from the fixing belt. Therefore, it is possible to stably suppress generation of gloss memory.

However, in a case where a jam occurs inside the fixing device having such a configuration, the jammed sheet is adhered to the fixing belt due to the toner of the toner image, so that the toner on the jammed sheet may be transferred to the fixing belt after jam troubleshooting in some cases. In addition, the toner carried by the fixing belt is transferred onto the cleaning roller, so that efficiency of removing the wax from the cleaning roller may be significantly degraded.

In this regard, a technique is disclosed in which a cleaning mode is provided to remove the toner and when a jam occurs, cleaning is performed using the web until the toner adhered to the cleaning roller is removed (refers to Japanese Patent Application Laid-Open No. 2015-169855). In the technique of Japanese Patent Application Laid-Open No. 2015-169855, in order to avoid damage to a heating roller, a force of pressing the web to the cleaning roller in the cleaning mode is set to be lower than that of the heating process, so as to reduce a rubbing resistance between the cleaning roller and the web.

SUMMARY

As described in Japanese Patent Application Laid-Open No. 2015-169855, for removing the toner adhered to the cleaning roller, a small amount of the toner is allowed to remain on the cleaning roller after cleaning of the cleaning roller. However, in a case where a purpose of the cleaning of the cleaning roller is to remove the wax, if any toner remains on the cleaning roller, the wax seeps out even from the remaining toner. Therefore, it is necessary to perfectly remove the toner remaining on the cleaning roller.

In the technique of Japanese Patent Application Laid-Open No. 2015-169855, the pressing force of the web to the cleaning roller in the cleaning mode is lower than that of the heating process. Therefore, a nip width between the cleaning roller and the web is narrowed, and adherence is degraded. As a result, cleaning efficiency of the cleaning roller using the web is degraded, and a lot of time is necessary for the cleaning disadvantageously.

In view of the aforementioned problems, an object of the present invention is to provide a fixing device and an image forming apparatus capable of improving cleaning efficiency of the cleaning roller using the web without damaging the fixing member in the cleaning mode.

To achieve at least one of the above-mentioned objects, according to an aspect of the present invention, a fixing device reflecting one aspect of the present invention includes a fixing member that heats and presses a toner image formed on a recording material to fix the toner image on the recording material; a cleaning member that abuts on the fixing member to clean the fixing member; a web that cleans the cleaning member; a first drive mechanism that moves the cleaning member so as to abut on or separate from the fixing member; a rotation drive unit capable of rotatingly driving the cleaning member when the cleaning member separates from the fixing member; and a control unit that performs control such that, in a case where a cleaning mode for cleaning the cleaning member using the web is selected, the cleaning member moves to separate from the fixing member and is rotatingly driven, and the web abuts on the cleaning member to clean the cleaning member.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
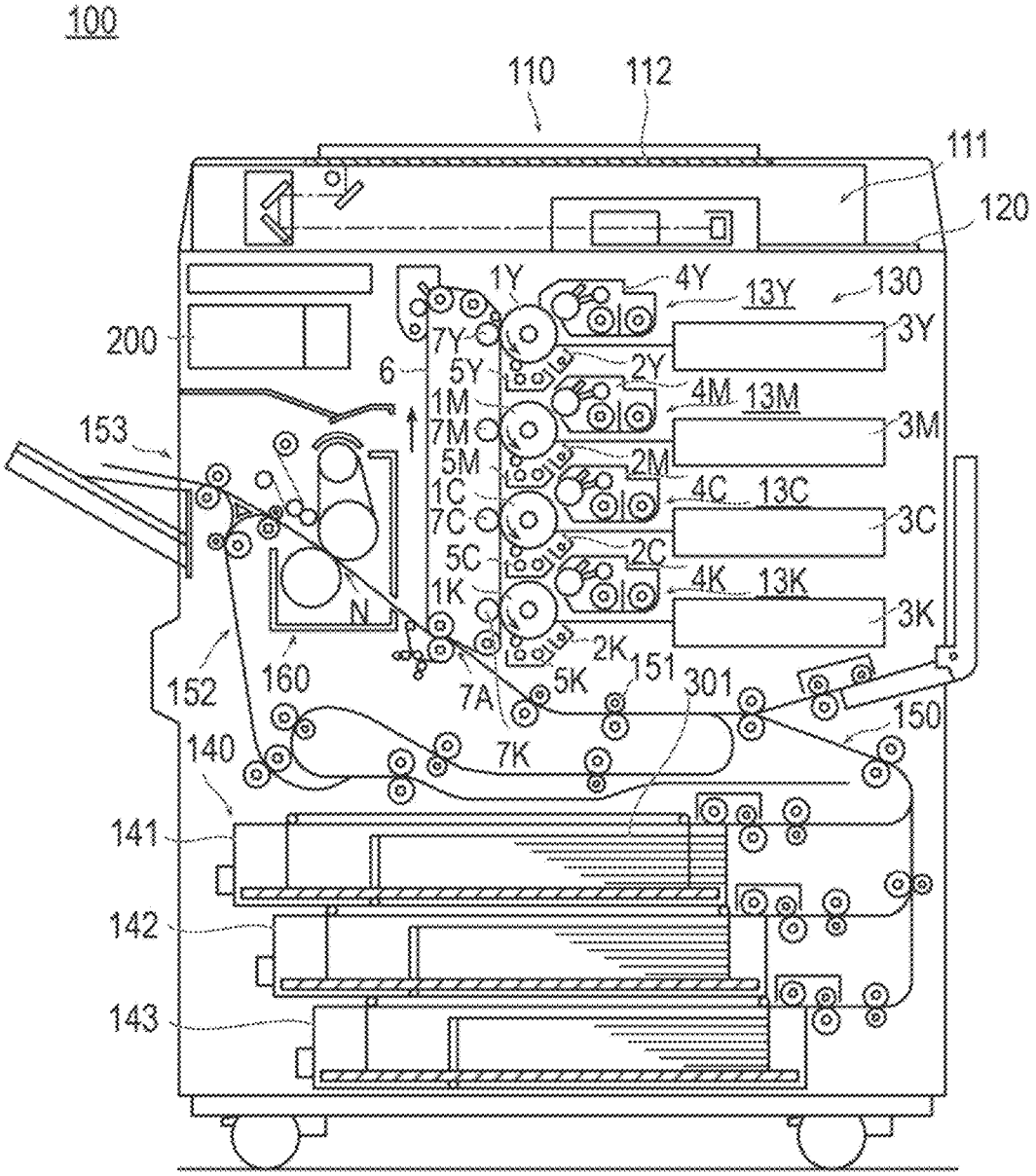
FIG. 1 is a schematic cross-sectional view illustrating a configuration of an image forming apparatus according to a first embodiment.

Hereinafter, one or more embodiments of the present invention will be described with reference to the drawings. However, the scope of the invention is not limited to the disclosed embodiments. Note that the same reference numerals denote the same elements throughout the drawings, and they will not be described repeatedly. In addition, dimensions or scales on the drawings may be exaggerated or different from actual ones for convenient description purposes.

First Embodiment

<Image Forming Apparatus 100>

Figure 2:
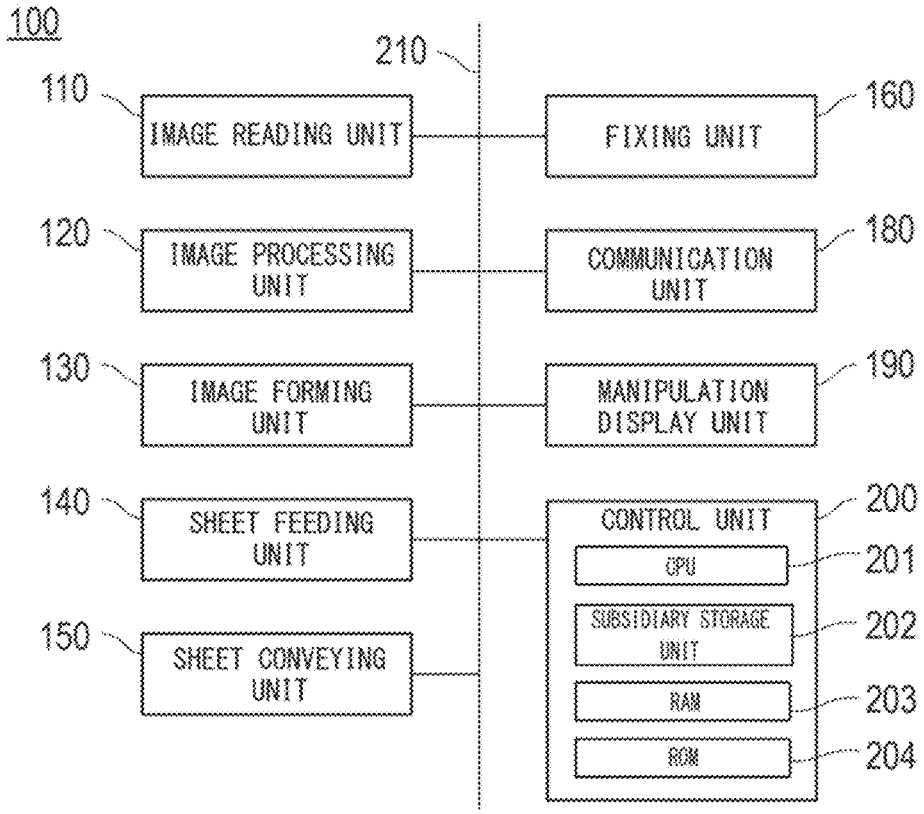
FIG. 2 is a schematic block diagram illustrating a configuration of the image forming apparatus of FIG. 1.

FIG. 1 is a schematic cross-sectional view illustrating a configuration of an image forming apparatus according to a first embodiment. FIG. 2 is a schematic block diagram illustrating a configuration of the image forming apparatus of FIG. 1.

The image forming apparatus 100 is a so-called tandem type color image forming apparatus that reads an image from an original and forms (prints) the read image on a sheet. In addition, the image forming apparatus 100 receives a print job including print data and print setting information having a PDL (page description language) format from an external client terminal via a network and forms an image on a sheet on the basis of the received print job. The client terminal may include, for example, a personal computer, a tablet terminal, a smart phone, or the like.

As illustrated in FIG. 2, the image forming apparatus 100 includes an image reading unit 110, an image processing unit 120, an image forming unit 130, a sheet feeding unit 140, a sheet conveying unit 150, a fixing unit 160, a communication unit 180, a manipulation display unit 190, and a control unit 200. These elements are communicably connected to each other by an internal bus 210.

The image reading unit 110 reads an original and outputs an image information signal. The original placed on the original cassette 112 is scanned and exposed by an optical system of a scan/exposure device of an image reader 111 and is read by a line image sensor. The photoelectrically converted image information signal is subjected to an analog processing, A/D conversion, shading correction, image compression, or the like in the image processing unit 120 and is then input to optical writing units 3Y, 3M, 3C, and 3K (described below) of the image forming unit 130 as print image data.

The image forming unit 130 forms an image on a sheet by performing an image forming process well known in the art, such as an electrophotographic method, including each of charging, exposure, development, and transfer processes on the basis of the print image data. The image forming unit 130 has a set of four subunits 13Y, 13M, 13C, and 13K for forming yellow (Y), magenta (M), cyan (C), and black (K) images, respectively.

The subunit 13Y includes a photosensitive drum 1Y and its surrounding parts such as a charging unit 2Y, an optical writing unit 3Y, a development device 4Y, and a drum cleaner 5Y.

Similarly, the subunit 13M includes a photosensitive drum 1M and its surrounding parts such as a charging unit 2M, an optical writing unit 3M, a development device 4M, and a drum cleaner 5M. Similarly, the subunit 13C includes a photosensitive drum 1C and its surrounding parts such as a charging unit 2C, an optical writing unit 3C, a development device 4C, and a drum cleaner 5C. Similarly, the subunit 13K includes a photosensitive drum 1K and its surrounding parts such as a charging unit 2K, an optical writing unit 3K, a development device 4K, and a drum cleaner 5K.

The photosensitive drums 1Y, 1M, 1C, and 1K, the charging units 2Y, 2M, 2C, and 2K, the optical writing units 3Y, 3M, 3C, and 3K, the development devices 4Y, 4M, 4C, and 4K, and the drum cleaner 5Y, 5M, 5C, and 5K are common between the subunits 13Y, 13M, 13C, and 13K. In the following description, the symbols Y, M, C, and K are not added unless it is necessary to distinguish them in particular.

The optical writing unit 3 of the image forming unit 130 writes the print image data on the photosensitive drum 1 to form a latent image based on the print image data on the photosensitive drum 1. In addition, the latent image is developed by the development device 4 to form a toner image as a visible image on the photosensitive drum 1. Note that a toner containing (including) wax formed of paraffin or polyolefin as a release agent may be used in the development device 4.

The photosensitive drums 1Y, 1M, 1C, and 1K of the subunits 13Y, 13M, 13C, and 13K form yellow (Y), magenta (M), cyan (C), and black (K) images, respectively.

The intermediate transfer belt 6 is wound around a plurality of rollers and is operably supported by them. The toner images having respective colors formed by the subunits 13Y, 13M, 13C, and 13K are sequentially transferred to the operating intermediate transfer belt 6 by the primary transfer units 7Y, 7M, 7C, and 7K to form a color image in which respective Y (yellow), M (magenta), C (cyan), and K (black) color layers are superimposed.

The sheet feeding unit 140 supplies a sheet 301 as a recording material to the image forming unit 130. The sheet feeding unit 140 has an upper tray 141, a middle tray 142, and a lower tray 143 in which different sizes of sheets such as an A4 size or A3 size are stored.

The sheet conveying unit 150 conveys the sheet 301. The sheet 301 supplied from the upper tray 141, the middle tray 142, or the lower tray 143 passes through the registration roller 151 and is conveyed to a secondary transfer unit 7A, so that the color image of the intermediate transfer belt 6 is transferred onto the sheet 301.

The sheet conveying unit 150 has a sheet reversing unit 152. The sheet 301 subjected to fixation is guided to the sheet reversing unit 152, so that the sheet 301 is discharged by reversing front and back sides or images can be formed on both sides of the sheet 301.

The fixing unit (fixing device) 160 fixes the toner image formed on the sheet 301. The sheet 301 having a fixed color image is discharged to the outside of the image forming apparatus 100 via the sheet discharge unit 153. The fixing unit 160 will be described below in details.

The communication unit 180 is connected to a client terminal such as a personal computer via a network to transmit or receive data on a print job or the like.

The manipulation display unit 190 has an input unit and an output unit. The input unit has, for example, a keyboard or a touch panel and is used by a user to input various settings or various commands such as a print command. In addition, the output unit has a display device to present a user with a device configuration, a print job status, a trouble report such as a jam during sheet conveyance, or the like.

The control unit 200 controls an image reading unit 110, an image processing unit 120, an image forming unit 130, a sheet feeding unit 140, a sheet conveying unit 150, a fixing unit 160, a communication unit 180, and a manipulation display unit 190. The control unit 200 has a CPU 201, a subsidiary storage unit 202, a RAM 203, and a ROM 204.

The CPU 201 executes a control program for the image forming apparatus. The control program is stored in the subsidiary storage unit 202 and is loaded on the RAM 203 in the event of execution of the CPU 201. The subsidiary storage unit 202 includes a large capacity storage device such as a hard disk drive or a flash memory. The RAM 203 stores a computation result or the like caused by execution of the CPU 201. The ROM 204 stores various parameters, various programs, or the like. The CPU 201 implements various functions by executing the control program.

<Configuration of Fixing Unit 160>

Figure 3:
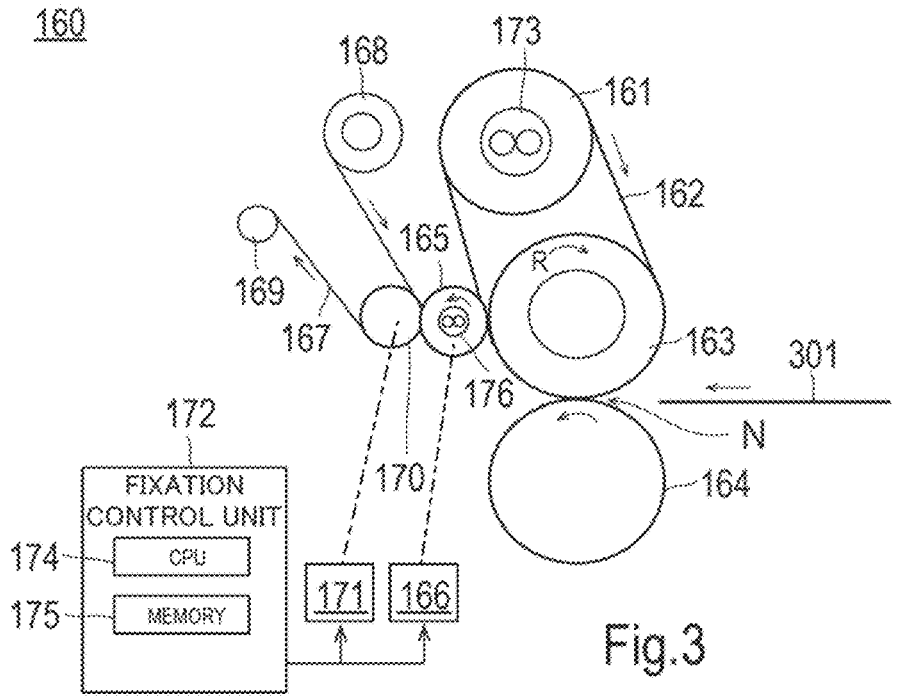
FIG. 3 is a schematic diagram illustrating a configuration of a fixing unit of FIG. 1.

Next, a specific configuration of the fixing unit 160 will be described with reference to FIG. 3. FIG. 3 is a schematic diagram illustrating a configuration of the fixing unit 160 of FIG. 1.

The fixing unit 160 has a heating roller 161, a fixing belt 162, a fixing roller 163, an pressure roller 164, a cleaning roller 165, a cleaning drive mechanism 166, a web 167, a feeding roller 168, a winding roller 169, a pressing roller 170, a pressing drive mechanism 171, and a fixation control unit 172

The heating roller 161 is, for example, a cylindrical mandrel formed of metal such as aluminum or a mandrel having an outer peripheral surface coated with a fluorine-based resin or the like. The heating roller 161 is embedded with a heater (such as a halogen heater) 173 as a heating unit for heating the fixing belt 162.

The fixing belt 162 is formed by, for example, covering an outer peripheral surface of a PI (polyimide) substrate having a thickness of 70 μm with an elastic layer and further covering a surface layer with a heat-resistant resin. The elastic layer may include, for example, heat resistant silicon rubber (hardness JIS-A 30 [°]) having a thickness of 200 μm. The heat-resistant resin may include, for example, PFA (perfluoroalkoxy) having a thickness of 30 μm. The fixing belt 162 is an endless belt, and is looped between the heating roller 161 and the fixing roller 163 with a predetermined belt tension (for example, 250 [N]).

The fixing belt 162 functions as a fixing member and comes into contact with the sheet 301 having the toner image to heat the sheet 301 to a fixation temperature. Here, the fixation temperature refers to a temperature at which heat necessary to melt the toner on the sheet 301 can be supplied (for example, 160 to 200° C.) and is different depending on a type of the sheet 301 where an image is formed. Note that the surface temperature of the fixing belt 162 is detected by a non-contact temperature sensor (not illustrated), and heating of the heater 173 is controlled by the fixation control unit 172 to maintain a predetermined setting temperature.

Outward from the inside, the fixing roller 163 includes a cylindrical metal mandrel, an elastic layer formed of silicone rubber, foamed silicone rubber, or the like and provided on a surface of the mandrel, and a release layer formed of a fluorine resin or the like. An axial length of the fixing roller 163 is set to sufficiently cover a maximum conveyable sheet width (for example, 300 mm). The fixing roller 163 receives power transmitted from a drive means (such as a motor) (not illustrated) and is rotatingly driven, for example, in an R-direction in FIG. 3. A drive speed of the fixing roller 163 may be set to, for example, approximately 200 [mm/s]. The fixing belt 162 is rotated to follow rotation of the fixing roller 163. Therefore, the fixing roller 163 is indirectly heated by the heater 173 via the fixing belt 162.

Outward from the inside, the pressure roller 164 includes a cylindrical metal mandrel, an elastic layer formed on a surface of the mandrel, and a release layer. The pressure roller 164 has the same outer diameter and axial length as those of the fixing roller 163, and includes an elastic layer and a release layer similar to those of the fixing roller 163. The pressure roller 164 pressedly comes into contact with the fixing roller 163 with a predetermined fixation load by nipping the fixing belt 162.

The sheet 301 conveyed from the image forming unit 130 to the fixing unit 160 is conveyed while being heated and pressed at the fixing nip portion N provided between the fixing belt 162 and the pressure roller 164, so that a toner image is fixed to the sheet 301.

The cleaning roller 165 functions as a cleaning member to remove the toner or the like adhered to an outer peripheral surface of the fixing belt 162 or the like. The cleaning roller 165 is a cylindrical mandrel formed of metal such as aluminum or a mandrel having an outer peripheral surface coated with a fluorine-based resin or the like.

The cleaning roller 165 is movable so as to approach or separate from the fixing belt 162 by a cleaning drive mechanism (first drive mechanism) 166. The cleaning roller 165 moves to a predetermined position close to the fixing belt 162 and is biased by a biasing means such as a spring (not illustrated) to press a part of the outer peripheral surface of the fixing belt 162 during cleaning of the fixing belt 162.

The fixing belt 162 is rotated by rotation of the fixing roller 163, and the cleaning roller 165 is also rotated by rotation of the fixing belt 162. That is, in a case where the cleaning roller 165 pressedly comes into contact with the fixing belt 162, the cleaning roller 165 rotates reversely to the rotational direction of the fixing roller 163 to follow rotation of the fixing roller 163. As a result, toner, wax, or the like adhered to an outer surface of the fixing belt 162 is transferred to the cleaning roller 165 so as to clean the outer peripheral surface of the fixing belt 162.

Meanwhile, when the cleaning roller 165 separates from the fixing belt 162 in the cleaning mode, the cleaning drive mechanism 166 functions as a rotation drive unit to rotatingly drive the cleaning roller 165.

The web 167 is a non-woven fabric formed of heat resistant fibers such as aramid fiber and has air permeability. The web 167 supplied from the feeding roller 168 comes into slidable contact with the outer peripheral surface of the cleaning roller 165, and is wound around the pressing roller 170 and the winding roller 169.

The winding roller 169 is rotated little by little by a motor (not illustrated) to wind the web 167. The winding amount is set to, for example, approximately 0.01 to 0.1 [mm] for printing one A4 size sheet. In addition, the feeding roller 168 has a brake means to constantly brake a movement of the web 167 to prevent slacking during the feeding operation of the web 167.

The pressing roller 170 is a cylindrical roller formed of metal with an SUS mandrel and has an outer peripheral surface coated with an elastic member (such as foamed silicone rubber). The pressing roller 170 is movable so as to approach or separate from the cleaning roller 165 by a pressing drive mechanism (second drive mechanism) 171. In the case of cleaning of the cleaning roller 165, the pressing roller 170 moves to a predetermined position close to the cleaning roller 165 and is biased by a biasing means such as a spring (not illustrated) to press the web 167 to the outer peripheral surface of the cleaning roller 165. As a result, the web 167 abuts on or pressedly comes into contact with the cleaning roller 165, so that the outer peripheral surface of the rotating cleaning roller 165 is rubbed by the web 167. As a result, toner, wax, or the like adhered to the outer peripheral surface of the fixing belt 162 is received by the web 167, so as to clean the outer peripheral surface of the cleaning roller 165.

The fixation control unit 172 has a CPU 174 and a memory 175, and the memory 175 has a RAM and a ROM. The CPU 174 executes a control program for the fixation control unit 172 to control a drive means of the fixing roller 163, the heater 173, the cleaning drive mechanism 166, a motor of the winding roller 169, and the pressing drive mechanism 171. The control program for the fixation control unit is stored in the ROM of the memory 175 and is loaded on the RAM when it is executed by the CPU 174.

<Operation Mode of Image Forming Apparatus 100>

Figure 4:
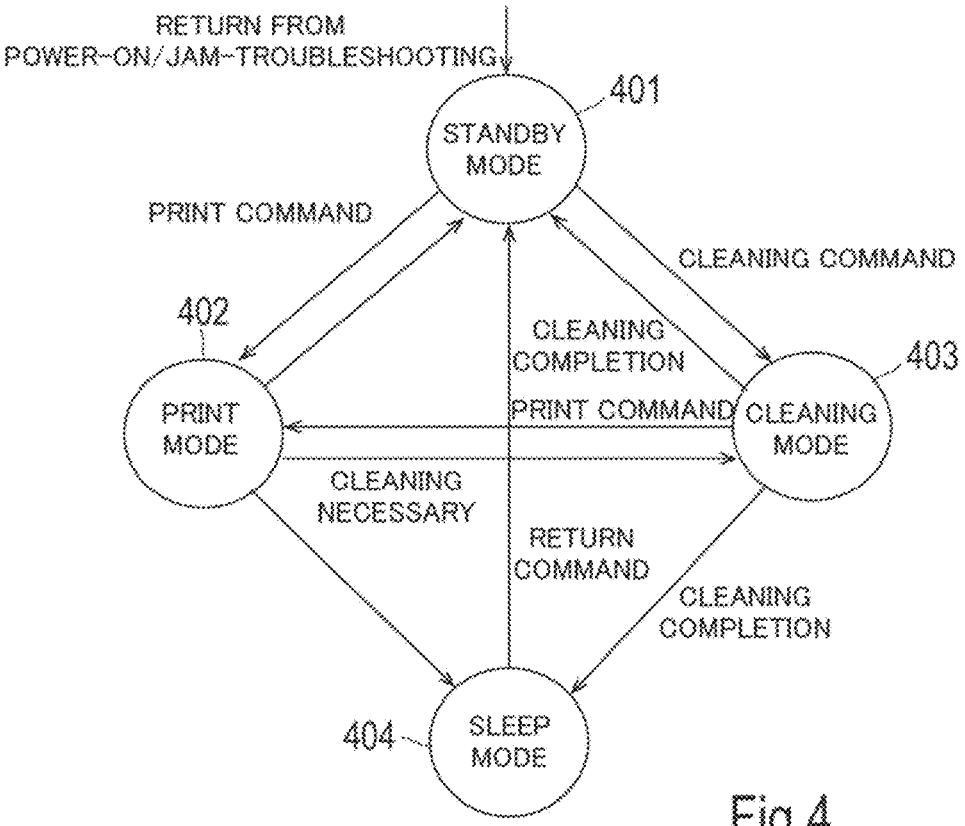
FIG. 4 is a conceptual diagram for describing an operation mode of the image forming apparatus of FIG. 1.

FIG. 4 is a conceptual diagram for describing an operation mode of the image forming apparatus 100.

Figure 5:
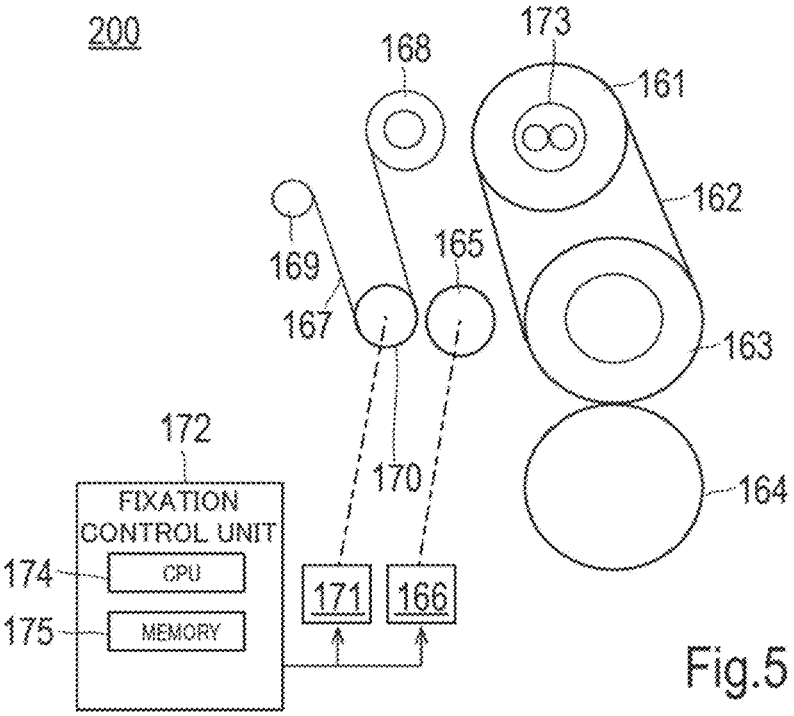
FIG. 5 is a schematic diagram illustrating positions of a cleaning roller and a pressure roller in a standby mode (in the event of a machine stop)
Figure 6:
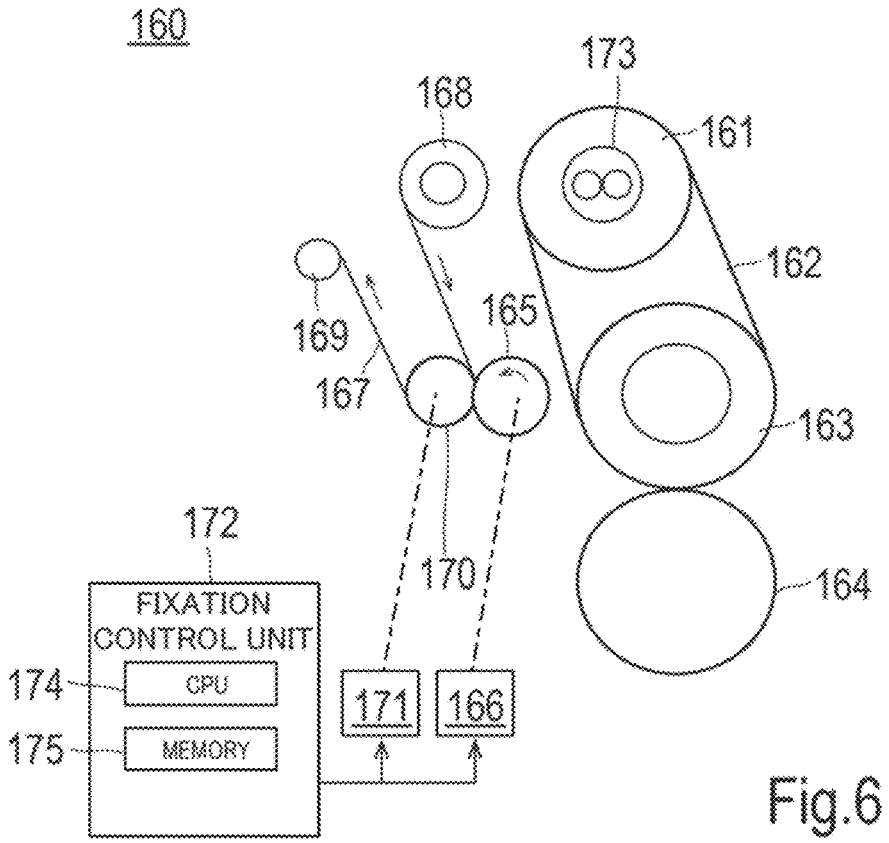
FIG. 6 is a schematic diagram illustrating positions of the cleaning roller and the pressure roller in a cleaning mode.

In addition, FIG. 5 is a schematic diagram illustrating positions of the cleaning roller 165 and the pressing roller 170 in a standby mode (in the event of a machine stop). FIG. 6 is a schematic diagram illustrating positions of the cleaning roller 165 and the pressing roller 170 in a cleaning mode.

As illustrated in FIG. 4, the image forming apparatus 100 has a plurality of operation modes including a standby mode 401, a print mode 402, a cleaning mode 403, and a sleep mode 404. Note that, in the example of FIG. 4, only the operation mode necessary for describing this embodiment is illustrated. The control unit 200 stores and manages information regarding the operation mode. The information regarding the operation mode is exchanged between the control unit 200 and the fixation control unit 172.

The image forming apparatus 100 advances the operation mode to the standby mode 401 immediately after power is on, when recovering from jam troubleshooting, or when recovering from the sleep mode 404. In the standby mode 401, the fixation control unit 172 moves the cleaning roller 165 and the pressing roller 170 to respective predetermined initial positions. As a result, the cleaning roller 165 separates from the fixing belt 162, and the web 167 separates from the cleaning roller 165. The initial position of the cleaning roller 165 is located between the fixing roller 163 and the pressing roller 170, which separates from both the fixing roller 163 and the pressing roller 170. Furthermore, the fixation control unit 172 performs control such that rotation of the winding roller 169 stops when the pressing roller 170 moves to separate from the cleaning roller 165.

In the standby mode 401, when a print command is received from a user, the control unit 200 advances the operation mode to the print mode 402. More specifically, when a print job is received from a client terminal, or when a user places an original on the image reading unit 110 and presses a print start button, the control unit 200 determines that a print command is received from a user, and advances the operation mode to the print mode 402.

In the print mode 402, the image forming apparatus 100 performs a typical print processing on the basis of the received print job or a print job created by reading the original. The fixing unit 160 fixes the sheet having the toner image. In addition, the fixing unit 160 causes the cleaning roller 165 to pressedly come into contact with the fixing belt 162 to clean the fixing belt 162, and causes the pressing roller 170 to abut on the cleaning roller 165 to clean the cleaning roller 165 (see FIG. 3). For example, in a case where there is no manipulation from a user for a predetermined period of time after the print processing is completed, the operation mode advances to the sleep mode 404.

Meanwhile, in the standby mode 401, in a case where a cleaning command is received from a user, the control unit 200 advances the operation mode to the cleaning mode 403. A user instructs the control unit 200 to advance to the cleaning mode 403, for example, by manipulating a touch panel or the like of the manipulation display unit 190.

As illustrated in FIG. 6, in a case where the cleaning mode 403 is selected, the fixation control unit 172 moves the cleaning roller 165 to separate from the fixing belt 162, that is, to be released from the fixing belt 162 and rotatingly drives the cleaning roller 165. In addition, the fixation control unit 172 performs control such that the web 167 abuts on the cleaning roller 165 to clean the cleaning roller 165. The fixation control unit 172 advances the operation mode from the cleaning mode 403 to the standby mode 401 after the cleaning of the cleaning roller 165 is completed.

In the cleaning mode 403, in a case where a print command is received from a user, the fixation control unit 172 advances the operation mode to the print mode 402.

<Control Method of Image Forming Apparatus 100>

Figure 7:
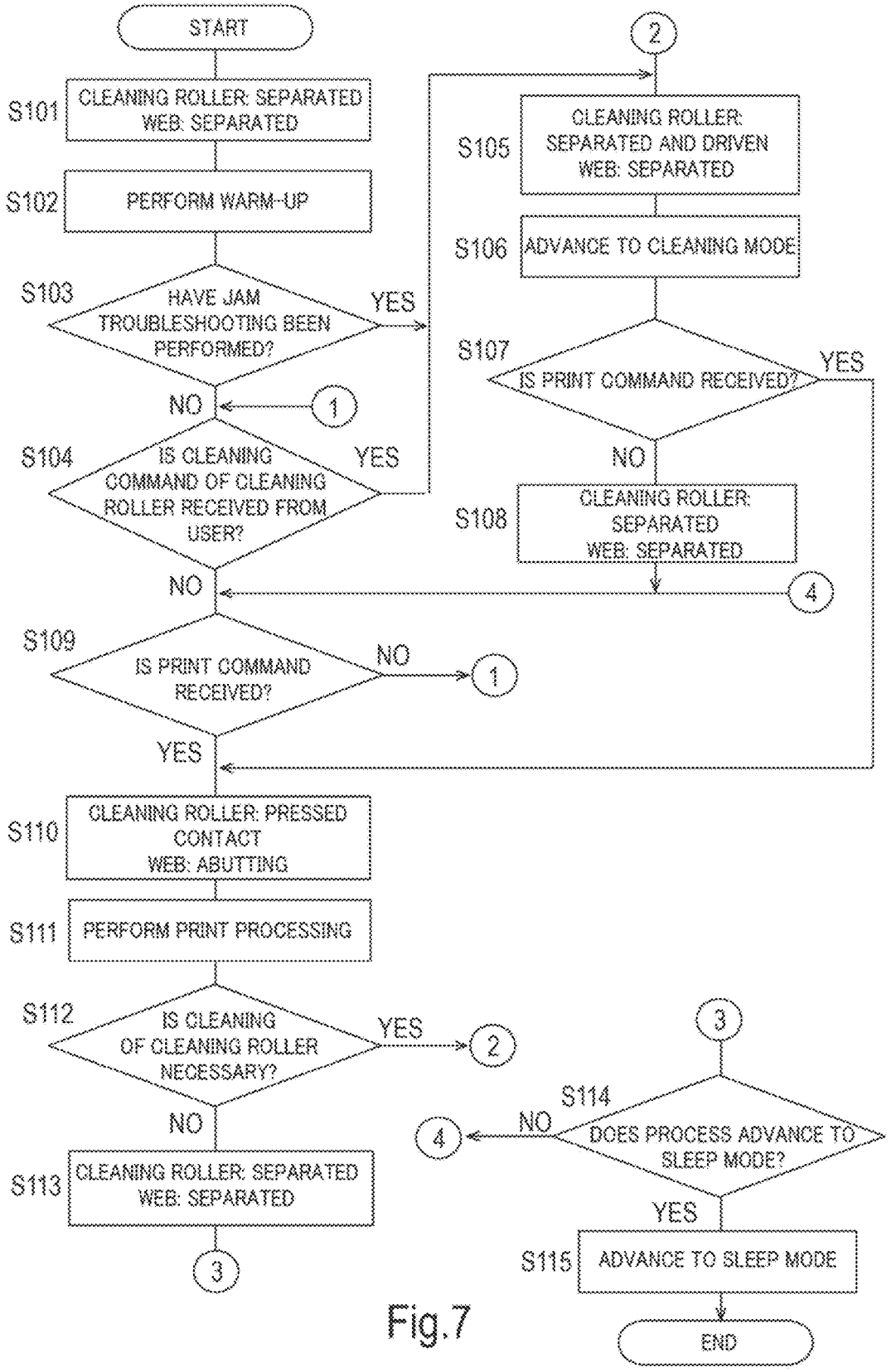
FIG. 7 is a flowchart illustrating a specific control method of the image forming apparatus according to the first embodiment.
Figure 8:
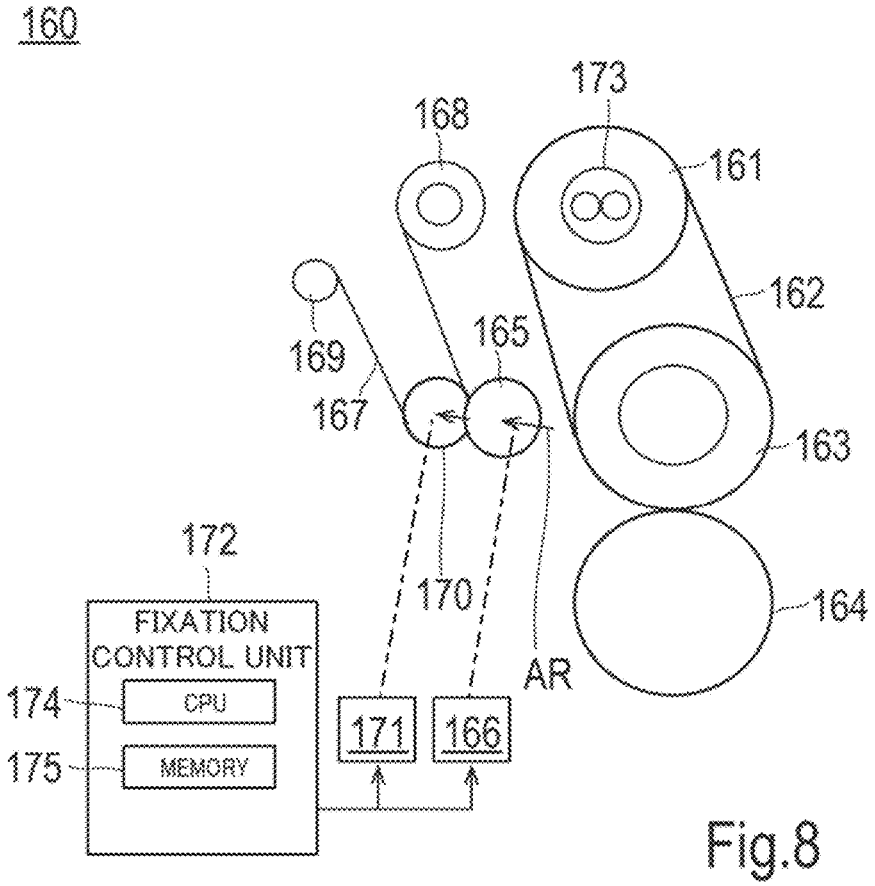
FIG. 8 is a schematic diagram for describing operations of the fixing unit in the cleaning mode according to the first embodiment.

FIG. 7 is a flowchart illustrating a specific control method of the image forming apparatus 100 according to this embodiment. The processing of the flowchart of FIG. 7 is implemented as the control unit 200 and the fixation control unit 172 execute the control program for the image forming apparatus and the control program for the fixation control unit, respectively. In addition, FIG. 8 is a schematic diagram for describing operations of the fixing unit in the cleaning mode according to the first embodiment.

The image forming apparatus 100 performs the following processing immediately after the power of the apparatus itself is on, when recovering from the sleep mode 404, or when recovering from jam troubleshooting.

The image forming apparatus 100 advances the operation mode to the standby mode 401. In the standby mode 401, the fixation control unit 172 separates the cleaning roller 165 from the fixing belt 162 and separates the web 167 from the cleaning roller 165 (step S101). That is, the fixation control unit 172 releases the cleaning roller 165 from the fixing belt 162 and releases the web 167 from the cleaning roller 165.

Subsequently, the fixation control unit 172 performs a warm-up operation of the fixing unit 160 (step S102). More specifically, the fixation control unit 172 performs control such that heating of the heater 173 of the heating roller 161 starts, and a temperature of the fixing belt 162 reaches a predetermined setting temperature on the basis of a measurement temperature of the non-contact temperature sensor described above. For example, when the temperature of the fixing belt 162 reaches the setting temperature, the fixation control unit 172 advances to the processing of the next step S103.

Subsequently, the fixation control unit 172 determines whether or not jam troubleshooting has been performed (step S103). If the jam troubleshooting has been performed (step S103: YES), the fixation control unit 172 advances to the processing of step S105.

Otherwise, if the jam troubleshooting has not been performed (step S103: NO), the fixation control unit 172 determines whether or not a cleaning command of the cleaning roller 165 is received from a user (step S104). If a cleaning command of the cleaning roller 165 is received from a user (step S104: YES), the fixation control unit 172 advances to the processing of step S105.

Note that the fixation control unit 172 cleans the fixing belt 162 by feeding a blank sheet to the fixing unit 160 before advancing to the cleaning mode in order to reduce a burden of the cleaning roller 165 for removing the toner adhered to the fixing belt 162. As a result, since most of the toner adhered to the fixing belt 162 is removed, the cleaning roller 165 is mainly used in cleaning of the wax adhered to the fixing belt 162. Furthermore, through the cleaning of the fixing belt 162 using a blank sheet, the amount of the toner transferred to the cleaning roller 165 is reduced. Therefore, the web 167 can be mainly used in cleaning of the wax adhered to the cleaning roller 165.

Meanwhile, if there is no cleaning command of the cleaning roller 165 from a user (step S104: NO), the fixation control unit 172 advances to the processing of step S109.

In step S105, the fixation control unit 172 separates the cleaning roller 165 from the fixing belt 162 and rotatingly drives the cleaning roller 165 reversely to the rotation direction R of the fixing roller 163. A rotation speed of the cleaning roller 165 may be appropriately set depending on a required cleaning time of the cleaning roller 165 using the web 167. In addition, the fixation control unit 172 separates the web 167 from the cleaning roller 165.

Subsequently, the fixation control unit 172 advances the operation mode to the cleaning mode 403 (step S106). As illustrated in FIG. 8, if the cleaning mode 403 is selected, the fixation control unit 172 moves the cleaning roller 165 and the pressing roller 170 to separate from the fixing belt 162 substantially in the same direction (for example, in the arrow direction AR). In this case, the fixation control unit 172 controls the cleaning drive mechanism 166 and the pressing drive mechanism 171 such that a movement amount of the pressing roller 170 becomes smaller than a movement amount of the cleaning roller 165. As a result, a center distance between both the rollers is reduced, and a pressing force of the pressing roller 170 to the cleaning roller 165 increases. For example, the fixation control unit 172 performs control such that a center distance between the cleaning roller 165 and the pressing roller 170 in the cleaning mode 403 is smaller than the center distance between both the rollers in the print mode 402. As a result, a nip width between the cleaning roller 165 and the web 167 (hereinafter, referred to as a "cleaning nip width") increases.

In this manner, by controlling the movement amounts of the cleaning roller 165 and the pressing roller 170, it is possible to control a pressing force of the pressing roller 170 to the cleaning roller 165. According to this embodiment, the cleaning nip width increases by separating the cleaning roller 165 from the fixing belt 162 and increasing a pressing force of the pressing roller 170 to the cleaning roller 165. Therefore, it is possible to improve cleaning efficiency of the cleaning roller 165 without generating an adverse effect such as damage to the fixing belt 162.

In comparison, as a comparative example, the pressing force of the cleaning roller to the fixing belt increases in a case where the web pressedly comes into contact with the cleaning roller while the cleaning roller abuts on the fixing belt, and the cleaning nip width increases. As a result, a rotation failure of the cleaning roller occurs, so that the fixing belt may be damaged.

The cleaning time of the cleaning roller 165 using the web 167 in the cleaning mode 403 may be set to approximately 30 to 60 [s], and preferably, 40 [s], but not limited thereto. If the cleaning time is set to 40 [s] or shorter, for example, it is possible to balance the cleaning time until the print processing starts because approximately forty seconds are necessary to complete a machine (image forming apparatus 100) recovery processing after jam troubleshooting and start a print processing. Therefore, it is possible to reduce a user waiting time caused by cleaning of the cleaning roller 165.

Returning to FIG. 7, the fixation control unit 172 determines whether or not a print command is received (step S107). If the print command is received (step S107: YES), the fixation control unit 172 advances to the processing of step S110. The control unit 200 advances to the processing of step S110 immediately after completing the cleaning of the cleaning roller 165 in the cleaning mode 403, so that the print mode 402 is executed. In step S110 described below, the cleaning roller 165 pressedly comes into contact with the fixing belt 162 while the web 167 abuts on the cleaning roller 165.

Note that, depending on a type of the sheet, it may be desirable to perform the print processing of step S111 while the cleaning roller 165 separates from the fixing belt 162, and the web 167 separates from the cleaning roller 165. Therefore, in consideration of such a case, pressed-contact/separation of the cleaning roller 165 to/from the fixing belt 162 and abutting/separation of the web 167 to/from the cleaning roller 165 may be selected depending on the type of the sheet.

Otherwise, if no print command is received (step S107: NO), the fixation control unit 172 advances the operation mode to the standby mode 401. In addition, the fixation control unit 172 separates the cleaning roller 165 from the fixing belt 162 and separates the web 167 from the cleaning roller 165 (step S108). In some cases, an amount of toner is cleaned within a short time in the cleaning of the cleaning roller 165 using the web 167. Therefore, there is a possibility that the toner adheres to the cleaning nip immediately after the cleaning. As a result, the web 167 may stick to the cleaning roller 165 when the temperature decreases. In addition, when the pressing roller 170 is pressed to support the web 167, there is a possibility that an elastic member formed on a surface of the pressing roller 170 is deformed and is not returned to its original state. In a case where the pressing roller 170 is recovered in this state, a load beyond necessity is applied to the pressing roller 170. Therefore, it is desirable to separate the web 167 from the cleaning roller 165, that is, release the cleaning roller 165 after completion of the cleaning.

In step S109, the fixation control unit 172 determines whether or not a print command is received. If no print command is received (step S109: NO), the fixation control unit 172 advances to the processing of step S104. The fixation control unit 172 maintains the standby mode until a cleaning command of the cleaning roller 165 or a print command is received.

Otherwise, if a print command is received (step S109: YES), the fixation control unit 172 causes the cleaning roller 165 to pressedly come into contact with the fixing belt 162 and causes the web 167 to abut on the cleaning roller 165 (step S110).

Subsequently, a print processing is performed (step S111). The control unit 200 performs control such that the image forming unit 130 forms a toner image on the sheet 301 on the basis of the print job, and the fixing unit 160 fixes the toner image formed on the sheet 301. The sheet 301 having the fixed image is discharged to the outside of the image forming apparatus 100 via the sheet discharge unit 153.

Subsequently, the fixation control unit 172 determines whether or not cleaning of the cleaning roller 165 is necessary (step S112). The fixation control unit 172 determines whether or not the cleaning of the cleaning roller 165 is necessary, for example, depending on the number of printed sheets after the cleaning of the cleaning roller 165 in the previous cleaning mode 403, or accumulation (coverage) of the image density.

If it is determined that the cleaning of the cleaning roller 165 is necessary (step S112: YES), the fixation control unit 172 advances to the processing of step S105.

Otherwise, if it is determined that the cleaning of the cleaning roller 165 is not necessary (step S112: NO), the fixation control unit 172 advances the operation mode to the standby mode 401. In addition, the fixation control unit 172 separates the cleaning roller 165 from the fixing belt 162 and separates the web 167 from the cleaning roller 165 (step S113).

Subsequently, the fixation control unit 172 determines whether or not the operation mode advances to the sleep mode (step S114). For example, if a command for requesting advancement to the sleep mode is received, the fixation control unit 172 advances the operation mode to the sleep mode 404 (step S115). Meanwhile, if a command for requesting advancement to the sleep mode is not received, the fixation control unit 172 does not advance the operation mode to the sleep mode (step S114: NO) but advances to the processing of step S109. The fixation control unit 172 advances the operation mode to the standby mode.

In this manner, according to this embodiment, in the event of a jam, the cleaning mode 403 can be automatically executed when a machine (image forming apparatus 100) recovery processing after jam troubleshooting is executed. In addition, the cleaning mode 403 can be automatically executed on the basis of whether or not a predetermined condition such as the number of printed sheets or the coverage is satisfied after completion of the print processing. Furthermore, a user may select execution of the cleaning mode 403 by manipulating a display of the manipulation display unit 190 or the like.

EXAMPLES

Figure 9A:
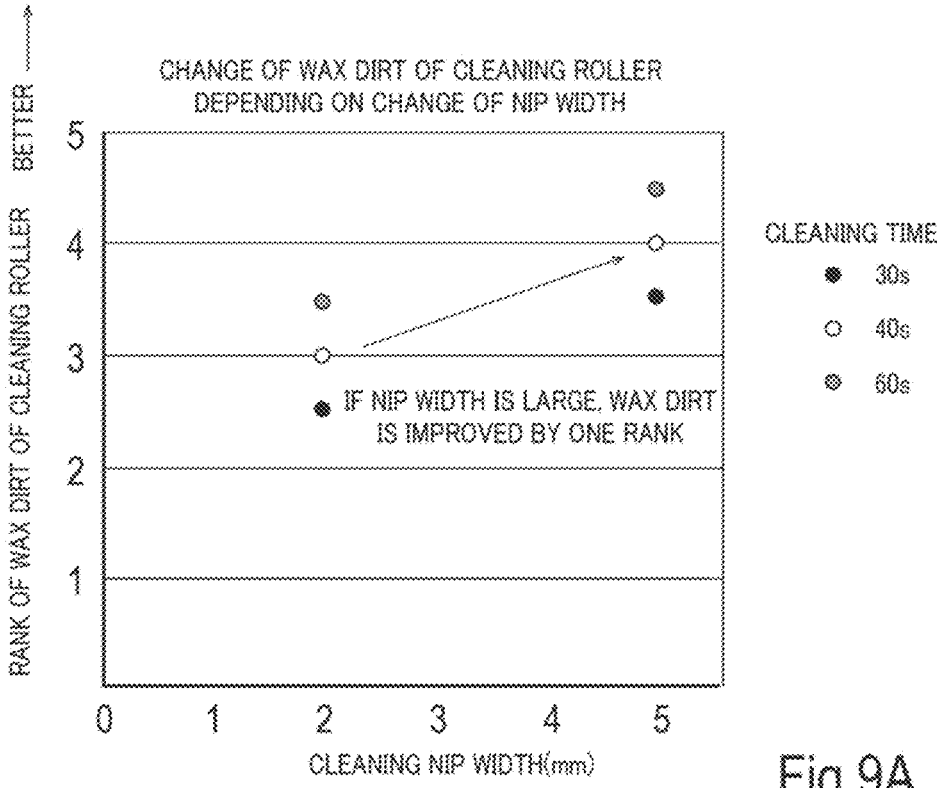
FIG. 9A is a diagram illustrating a change of wax dirt of the cleaning roller depending on a change of a cleaning nip width under the same average nip surface pressure.

FIG. 9A is a diagram illustrating a change of wax dirt of the cleaning roller 165 depending on a change of the cleaning nip width under the same average nip surface pressure. In addition, FIG. 9B is a diagram illustrating a change of wax dirt of the cleaning roller 165 depending on a change of the average nip surface pressure under the same cleaning nip width as a comparative example.

As illustrated in FIG. 9A, for example, the cleaning roller 165 was cleaned by setting the cleaning nip width 2 [mm] and 5 [mm], and a wax dirt state of the cleaning roller 165 was visually checked. Note that, in order to set the same average nip surface pressure, a stiff material was employed in the elastic member of the pressing roller 170, and the cleaning nip width was set to 2 [mm]. In addition, a soft material was employed in the elastic member, and the cleaning nip width was set to 5 [mm].

As a result, in any case where the cleaning time is set to 30 [s], 40 [s], or 60 [s], a wax dirt rank of the cleaning roller 165 was improved by one rank by widening the cleaning nip width from 2 [mm] to 5 [mm]. That is, the wax dirt was reduced.

Figure 9B:
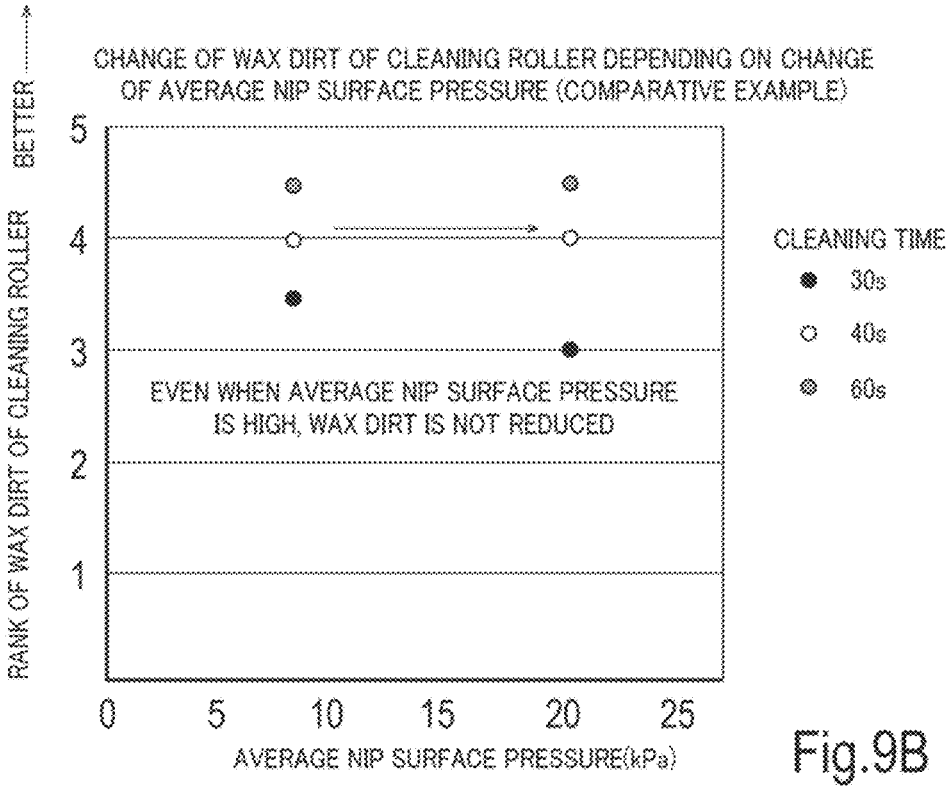
FIG. 9B is a diagram illustrating a change of wax dirt of the cleaning roller depending on a change of the average nip surface pressure under the same cleaning nip width as a comparative example.

Meanwhile, as illustrated in FIG. 9B, for example, the cleaning roller 165 was cleaned by setting the average nip surface pressure to 7.5 [kPa] and 19 [kPa], and a wax dirt state of the cleaning roller 165 was visually checked. Note that, in order to set the same cleaning nip width (4 [mm]), a soft material was employed in the elastic member of the pressing roller 170, and the average nip surface pressure was set to 7.5 [kPa]. In addition, a stiff material was employed in the elastic member, and the average nip surface pressure was set to 19 [kPa].

As a result, in a case where the cleaning time is set to 40 [s] and 60 [s], there was no change in the wax dirt rank of the cleaning roller 165 even by increasing the average nip surface pressure from 7.5 [kPa] to 19 [kPa].

That is, the wax dirt was not reduced. In addition, in a case where the cleaning time is set to 30 [s], the wax dirt rank of the cleaning roller 165 was degraded by increasing the average nip surface pressure from 7.5 [kPa] to 19 [kPa]. That is, the wax dirt increases rather.

In this manner, it is possible to reduce wax dirt of the cleaning roller 165 and improve cleaning efficiency by widening the cleaning nip width in the cleaning. Meanwhile, the wax dirt of the cleaning roller 165 is not reduced, and the cleaning efficiency is not improved even by increasing the average nip surface pressure.

In the fixing unit 160 and the image forming apparatus 100 described above according to this embodiment, the cleaning roller 165 is rotatingly driven while separating from the fixing belt 162 to clean the cleaning roller 165 using the web 167. Therefore, since the pressing force from the pressing roller 170 to the cleaning roller 165 is not transmitted to the fixing belt 162, it is possible to improve cleaning efficiency of the cleaning roller 165 using the web 167 without damaging the fixing belt 162. As a result, it is possible to suppress or prevent gloss memory.

Note that the cleaning roller 165 may have a heater (heating means) 176 (see FIG. 3). In this configuration, it is possible to sufficiently heat the toner on the cleaning roller 165. Therefore, a solid toner or the toner adhered to the cleaning roller 165 is melted, so that it is possible to efficiently clean the cleaning roller 165.

Second Embodiment

In the first embodiment, a case where the cleaning roller 165 and the pressing roller 170 separate from the fixing belt 162 substantially in the same direction when the cleaning roller 165 is cleaned using the web 167 in the cleaning mode 403 has been described. According to the second embodiment, a movement direction of the cleaning roller 165 is different from the movement direction of the pressing roller 170. Note that configurations similar to those of the first embodiment will not be described for simplicity purposes.

Figure 10:
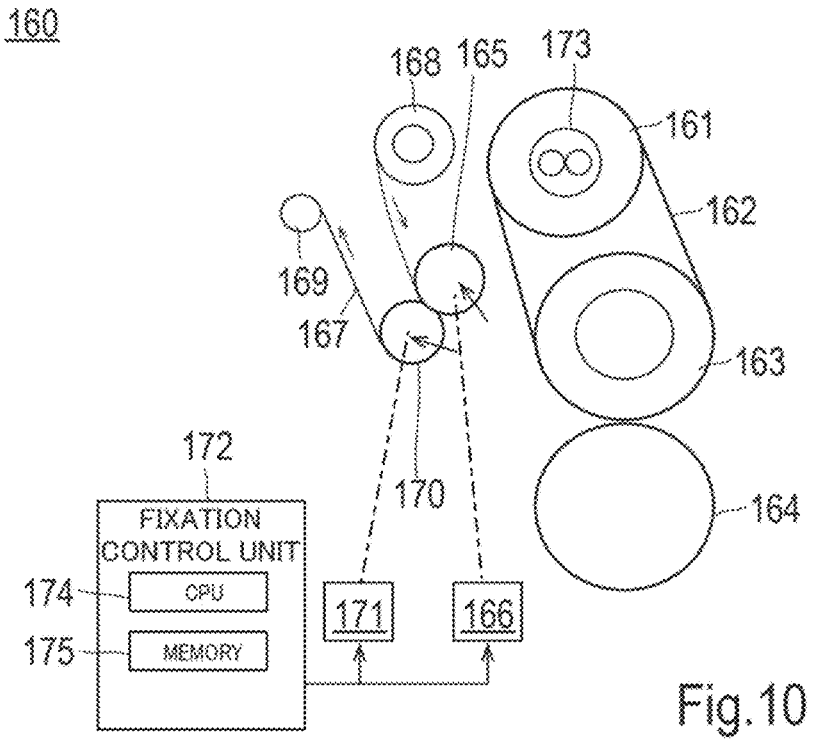
FIG. 10 is a schematic diagram for describing operations of the fixing unit in a cleaning mode according to the second embodiment.

FIG. 10 is a schematic diagram for describing operations of the fixing unit 160 in the cleaning mode 403 according to the second embodiment. According to this embodiment, when the cleaning roller 165 is cleaned using the web 167, the cleaning roller 165 and the pressing roller 170 separate from the fixing belt 162 in different directions. That is, the fixation control unit 172 performs control such that the cleaning roller 165 moves in a direction different from that of the pressing roller 170.

As the pressing roller 170 moves, the web 167 is wound around the pressing roller 170 by virtue of a tension between the feeding roller 168 and the pressing roller 170 or a tension between the winding roller 169 and the pressing roller 170.

The fixation control unit 172 moves the cleaning roller 165 to separate from the fixing belt 162 in order to cause the web 167 wound around the pressing roller 170 to adjoin the outer peripheral surface of the cleaning roller 165. In this case, the fixation control unit 172 controls the positions of the cleaning roller 165 and the pressing roller 170 such that winding of the web 167 around the pressing roller 170 increases. As a result, it is possible to widen the cleaning nip width.

Third Embodiment

According to the third embodiment, a pressing belt looped with a constant tension is employed instead of the pressing roller 170 of the first embodiment in order to press the web 167 to the cleaning roller 165. Note that configurations similar to those of the first embodiment will not be described for simplicity purposes.

Figure 11:
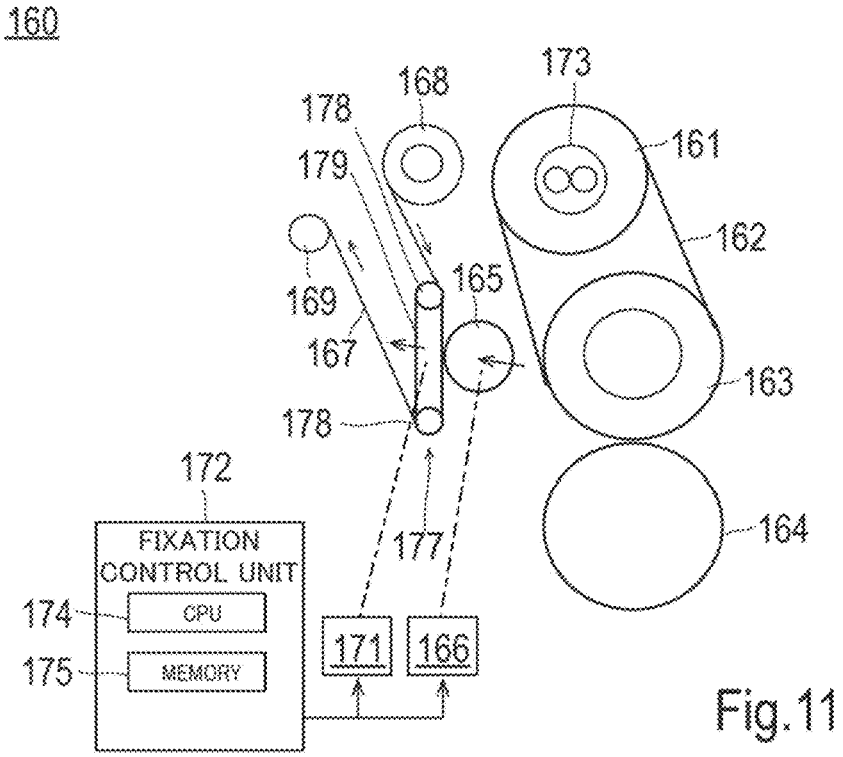
FIG. 11 is a schematic diagram for describing operations of the fixing unit in the cleaning mode according to the third embodiment.

FIG. 11 is a schematic diagram for describing operations of the fixing unit 160 in the cleaning mode 403 according to the third embodiment. According to this embodiment, the fixing unit 160 has a pressing mechanism 177. The pressing mechanism 177 has a pair of support rollers 178 and a pressing belt 179. The pair of support rollers 178 are arranged in parallel at a predetermined interval and are capable of rotatingly driving at the same speed using a drive means (for example, motor) (not illustrated). In addition, the pressing belt 179 is looped such that a constant tension is applied between the pair of support rollers 178.

The pressing mechanism 177 is movable so as to approach or separate from the cleaning roller 165 by using a pressing drive mechanism (third drive mechanism) 171 and presses the pressing belt 179 toward the cleaning roller 165 by virtue of its tension while nipping the web 167.

The fixation control unit 172 performs control such that a distance between the pressing mechanism 177 and the cleaning roller 165 in the cleaning mode 403 is smaller than a distance between the pressing mechanism 177 and the cleaning roller 165 in the print mode 402. More specifically, the fixation control unit 172 performs control such that a distance between a plane including both shafts of a pair of support rollers 178 and a shaft of the cleaning roller 165 in the cleaning mode 403 is smaller than a distance between the plane including both shafts of the pair of support rollers 178 and the shaft of the cleaning roller 165 in the print mode 402.

As the distance between the pressing mechanism 177 and the cleaning roller 165 is reduced, an area of the pressing belt 179 wound around the cleaning roller 165 by nipping the web 167 increases, so that the cleaning nip width increases. In addition, according to this embodiment, since the pressing belt 179 is looped with a constant tension, even when the distance between the pressing mechanism 177 and the cleaning roller 165 is reduced, a change of the pressing force from the pressing mechanism 177 to the cleaning roller 165 is reduced. Furthermore, since the web 167 is supported, the cleaning effect increases.

While embodiments have been described hereinbefore, it would be appreciated that various additions, modifications, and omissions may be possible by a person ordinarily skilled in the art within the spirit and scope of the invention.

Although embodiments of the present invention have been described and illustrated in detail, it is clearly understood that the same is by way of illustration and example only and not limitation, the scope of the present invention should be interpreted by terms of the appended claims.

The entire disclosure of Japanese Patent Application No. 2018-053074, filed on Mar. 20, 2018, is incorporated herein by reference in its entirety.

The invention claimed is:

1. A fixing device comprising:

a fixing member that heats and presses a toner image formed on a recording material to fix the toner image on the recording material;

a cleaning member that abuts on the fixing member to clean the fixing member;

a web that cleans the cleaning member;

a first drive mechanism that moves the cleaning member so as to abut on or separate from the fixing member;

a rotation drive unit capable of rotatingly driving the cleaning member when the cleaning member separates from the fixing member; and a control unit that performs control such that, in a case where a cleaning mode for cleaning the cleaning member using the web is selected, the cleaning member moves to separate from the fixing member and is rotatingly driven, and the web abuts on the cleaning member to clean the cleaning member.

2. The fixing device according to claim 1, wherein the web is capable of abutting on or separating from the cleaning member even when the cleaning member separates from the fixing member, and the control unit performs control such that, in a case where a mode advances to a print mode immediately after cleaning of the cleaning member in the cleaning mode is completed, the cleaning member pressedly comes into contact with the fixing member while the web abuts on the cleaning member.

3. The fixing device according to claim 1, wherein the web is capable of abutting on or separating from the cleaning member even when the cleaning member separates from the fixing member, and the control unit performs control such that, in a case where a mode does not advance to a print mode immediately after cleaning of the cleaning member in the cleaning mode is completed, the web separates from the cleaning member.

4. The fixing device according to claim 3, wherein a mode advances to the print mode in a case where a print command is received after the cleaning member separates from the web.

5. The fixing device according to claim 1, wherein the control unit performs control such that, in a case where the cleaning mode is selected, a nip width between the cleaning member and the web is wider than a nip width of a print mode.

6. The fixing device according to claim 5, wherein the fixing device further comprises:

a pressing roller that press the web to the cleaning member, and a second drive mechanism that moves the pressing roller; and wherein the control unit performs control such that a center distance between the cleaning member and the pressing roller in the cleaning mode is smaller than a center distance between the cleaning member and the pressing roller in the print mode in order to widen a nip width between the cleaning member and the web.

7. The fixing device according to claim 6, wherein the control unit controls a pressing force of the pressing roller such that a center distance between the cleaning member and the pressing roller in the cleaning mode is smaller than a center distance between the cleaning member and the pressing roller in the print mode, in order to widen a nip width between the cleaning member and the web.

8. The fixing device according to claim 5, wherein the fixing device further comprises:

a feeding roller that supplies the web, a winding roller that winds the web, and a pressing roller around which the web is wound to press the web to the cleaning member; and wherein the control unit controls positions of the pressing roller and the cleaning member such that a constant tension is applied to the web between the feeding roller and the pressing roller and between the winding roller and the pressing roller by moving the pressing roller, and winding of the web around the pressing roller caused by a tension between the feeding roller and the pressing roller or a tension between the winding roller and the pressing roller increases in the cleaning mode, in order to widen a nip width between the cleaning member and the web.

9. The fixing device according to claim 5, wherein the fixing device further comprises:

a pressing mechanism having a pair of support rollers arranged in parallel and a pressing belt looped around the pair of support rollers to apply a constant tension, the pressing mechanism pressing the pressing belt to the cleaning member by virtue of a tension of the pressing belt while nipping the web, and a third drive mechanism that moves the pressing mechanism; and wherein the control unit performs control such that a distance between a plane including both shafts of the pair of support rollers and a shaft of the cleaning member in the cleaning mode is smaller than a distance between a plane including both shafts of the pair of support rollers and a shaft of the cleaning member in the print mode, in order to widen a nip width between the cleaning member and the web.

10. The fixing device according to claim 1, wherein the cleaning member internally has a heater.

11. An image forming apparatus comprising:

an image forming unit that forms an image on a recording material, and the fixing device according to claim 1;

wherein the cleaning mode is executed when recovering from jam troubleshooting.

12. An image forming apparatus comprising:

an image forming unit that forms an image on a recording material, and the fixing device according to claim 1;

wherein the cleaning mode is executed when a print processing is completed, and a predetermined condition is satisfied.

13. An image forming apparatus comprising:

an image forming unit that forms an image on a recording material, and the fixing device according to claim 1;

wherein the cleaning mode is executed in response to a user's command.

* * * * *